United States Patent [19]

Patel et al.

[11] 4,327,830

[45] May 4, 1982

[54] RECORD STAMPER PROTECTOR

[75] Inventors: Bhupendra P. Patel; John J. Prusak, both of Indianapolis, Ind.

[73] Assignee: RCA Corporation, New York, N.Y.

[21] Appl. No.: 230,358

[22] Filed: Jan. 30, 1981

[51] Int. Cl.[3] ..... B65D 65/04; B65D 85/57

[52] U.S. Cl. ..... 206/303; 150/52 R; 206/15; 206/309; 206/310; 206/312; 369/292

[58] Field of Search ..... 206/303, 307, 15, 309, 206/310, 311, 312; 274/1 R; 150/52 R

[56] References Cited

U.S. PATENT DOCUMENTS

| | | | |
|---|---|---|---|
| 1,137,126 | 4/1915 | Fuller | 206/310 |
| 3,140,095 | 3/1964 | Henry | 206/15 |
| 3,961,656 | 6/1976 | Aggarwal | 150/52 R |

*Primary Examiner*—George E. Lowrance

*Attorney, Agent, or Firm*—Birgit E. Morris; Edward J. Sites

[57] ABSTRACT

A stamper protector is disclosed which is comprised of a recording cover and a center cover. The recording cover is made of a laminated material which has a tough outer layer and a resilient soft inner layer. The recording cover is cut in the form of an annular ring of a size such that it will cover the entire recorded area of the stamper from the outer molding land to the unrecorded center portion of the stamper. The center cover is cut to a size which will cover the entire center of the recording cover when it is adhered to the outer layer of the recording cover.

7 Claims, 2 Drawing Figures

RECORD STAMPER PROTECTOR

This invention relates to a cover for protecting a record stamper. More particularly, a record stamper protector is provided which prevents scratching and contamination of the molding surface of the record stamper until the stamper is mounted in a record press.

BACKGROUND OF THE INVENTION

Records such as conventional audio records and the newer video records are manufactured by molding a thermoplastic composition between a pair of metal discs referred to as stampers.

The stampers are manufactured by a process referred to as matrixing. The information which is desired to be molded on the final record is initially recorded on a magnetic tape. A surface relief pattern which corresponds to the recorded information is cut into a recording substrate using the magnetic tape to control the cutting tool. Conventional records, such as the audio record, are cut into a wax or laquer substrate. The new high information density record, such as the video record, are cut into hard substrates such as bright electrodeposited copper substrates. The recording substrate is then prepared for electroforming by activating the surface wax or lacquer substrates and passivating the surface of the recorded metal substrates. The recording substrate is then electroplated with a metal such as nickel to provide a master which is a negative replication of the recording substrate. The grooved surface of the master is then passivated and in turn electroplated to form a mold which is a positive replication of the recording substrate. The grooved surface of the mold is then electroplated to form a stamper which is again a negative replication of the recording substrate. The stamper is the part which is mounted in a molding press and which presses the record disc.

The quality of the records which are pressed with a given stamper is directly related to the condition of the molding surface of the stamper. If the molding surface is free from defects, the records pressed from the stampers should have excellent fidelity to the original recording. If, however, the molding surface of the stamper is mechanically damaged, such as being scratched or contaminated with foreign material such as oils or dirt, the record pressed with the stampers reflect the condition of the stampers by having relatively poor fidelity and in extreme cases the records may not even be playable.

The problem of mechanical damage and surface contamination of the molding surfaces of stampers is a longstanding problem in the record molding art. Scratching of the surface of the record stampers is one of the most prevalent causes for rejection of stampers in the manufacture of audio and video records. In addition, when the surface is contaminated by the oil or dirt or by coatings applied to the stampers or other foreign materials, it has been found that the fidelity of the audio records is also markedly reduced.

In the audio record art, it has been common practice to chromium plate the molding surface of the stampers in order to make them harder and therefore more scratch resistant and to inhibit contamination by foreign materials. These efforts at best have only had moderate success with audio record stampers as the aforementioned problems continue to persist in the audio record art.

In the manufacture of the newer type high density information records, such as the video records, wherein the recorded signal elements are much smaller than on audio record surfaces scratching and surface contamination pose considerably greater problems. The recorded signals on a high information density record are generally orders of magnitude smaller than in the signal elements on an audio record. Accordingly, scratches which would be of little concern on an audio record stamper present major problems with regard to the high information density record stampers in that often the scratches, even the microscratches, are as large or even larger than the recorded signal elements. The problem of surface contamination likewise is a more serious problem in the manufacture of high information density records as compared to the audio records. Surface contamination even such contamination as, for example, the thin film of oil from the fingerprints of the operators and the like, can impart defects to the records made with the record stampers.

The problems of mechanical damage and surface contamination are made even more complex with regard to the high information density record stampers; in that unlike the audio records stampers, they cannot be effectively chromium plated in order to improve their scratch resistance and to decrease the tendency for foreign materials to adhere to the surface of the stampers. The reason for this is that chromium plating, in order to be effective, must be applied in a relatively thick layer. The chromium plating reduces the fidelity of reproduction of information on an audio record, but it is considered to be an acceptable tradeoff for the added protection. On high information density record stampers, because of the extremely small size of the recorded signal elements, the chrome plating tends to obliterate the signal when applied in a sufficiently thick plating to offer any substantial amount of protection. For this reason, it is necessary in the manufacture of high information density records to use virgin nickel stampers which are inherently easier to scratch and are more subject to surface contamination.

It has been found that a substantial proportion of mechanical damage, and also the contamination of the surface of the stampers, occurs from the time the stamper is completed in the matrixing process until it is mounted in a press for the pressing of records. Part of the cause of the damage to the stampers is a result of the numerous handling operations the stampers are exposed to before being mounted in the molding press. In the matrixing process, it is customary to electroform in a single production run all the stampers which are anticipated to be required for the molding of a given run of records. Accordingly, as the process is being run, stampers are generated which are sent to either intermediate or longterm storage. The stampers are examined prior to being placed in storage to determine any visual defects on the stampers and an identification code is inscribed on the unrecorded center portion of the stampers for future identification of the stampers and the records pressed on the stampers.

After the inspection, the stampers are stored for future use. The molding surface was heretofore often left exposed but this has been proven to be an extremely poor practice. It has been suggested to apply a film of plastic to the surface of the stamper which can be stripped after the stamper is installed in the press. The film, however, offers at best minimal protection, and even when stripped often leaves a microresidue on the molding surface. It has also been suggested to place the stamper in an envelope similar to dust covers used for molded records or to place the stamper in a can similar to that used for the storage of motion picture films and the like. Both of these suggestions were not satisfactory as it must be removed and handled in an unprotected state when an operator is examining or working with the stamper.

When the stampers are required for the molding of the records, they are then removed from the storage area and forwarded to the molding area. In the molding area, an operator removes the stamper from its protective cover, checks the identification of the stamper, engraved in the center portion of the stamper, and then mounts the stamper onto the platens of the record molding press. In order to remove the stamper, examine it and mount it in the press, the operator is required to handle the stamper. In the course of mounting the stamper, it is almost inevitable that the operator will inadvertently contact the molding surface of the stamper leaving fingerprints on the stamper. In addition, because of the inherent presence of oils, such as hydraulic fluids and the like, in the area of the presses, it is not uncommon for substantial quantities of oily materials to contaminate the surface of the exposed stampers. It has also been found that in the course of mounting the stampers onto the press, that the stampers are highly vulnerable to being scratched. This can occur from being contacted by another stampers or by the tools used to mount the stampers which can inadvertently contact the molding surface of the stamper. Scratches are often imparted to the stamper during mounting which immediately makes the stamper unsuitable for the molding of records. There are, of course, many other situations wherein the stamper is subject to damage prior to being mounted in the stamper. Once the stamper is mounted in the press, the danger of damaging the stamper is substantially reduced in that generally the operator does not contact the molding surface of the stamper in use, and furthermore, tools are not being brought into contact with the molding surface of the stamper until it is desired to remove the stamper from the press.

Accordingly, it would be highly advantageous if an apparatus could be provided which would protect the surface of the stamper from the time it is completed in the matrixing area, until the time it is completely mounted in the press and is ready for the pressing of records.

SUMMARY OF THE INVENTION

A stamper protector is disclosed which is comprised of a recording cover and a center cover. The recording cover is made of a laminated material which has a tough outer layer and a resilient non abrasive inner layer. The recording cover is cut in the form of an annular ring of a size such that it will cover the entire recorded area of the stamper from the outer molding land to the unrecorded center portion of the stamper. The center cover is cut to a size which will cover the entire center of the recording cover when it is adhered to the outer layer of the recording cover.

BRIEF DESCRIPTIONS OF THE DRAWINGS

DETAILED DESCRIPTION OF THE INVENTION

Figure 1:
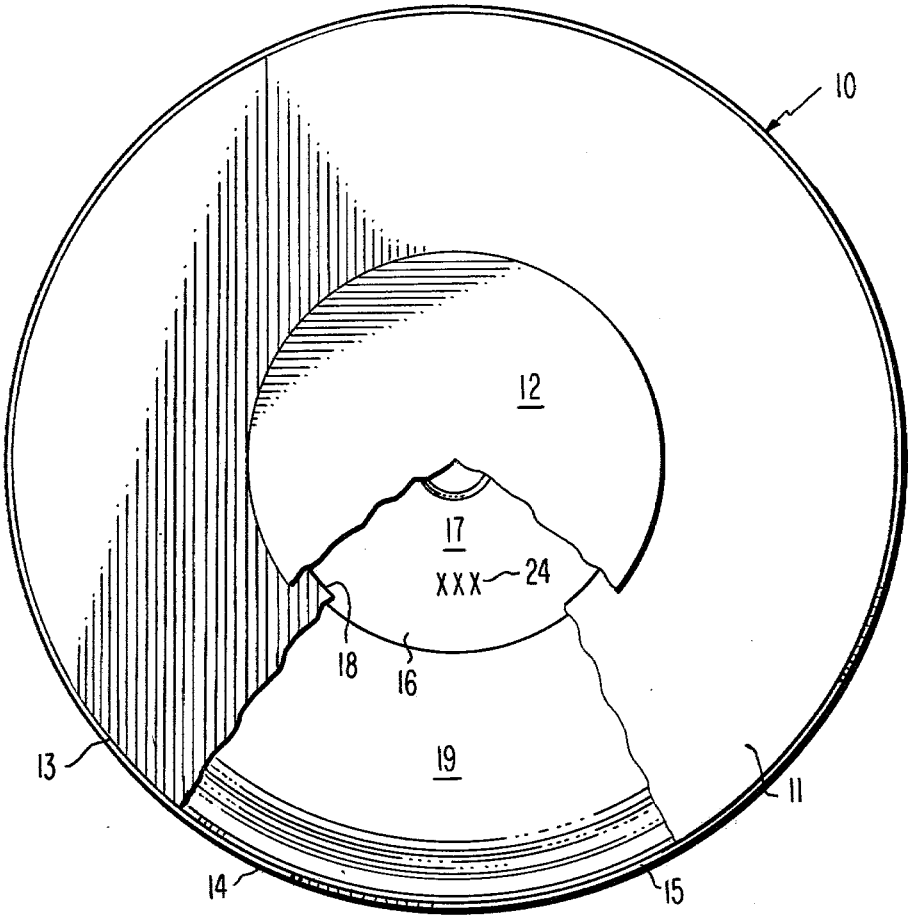
FIG. 1 is a top plane view of the stamper protector of the invention shown with part broken away for the purpose of illustration and in combination with a record stamper.
Figure 2:
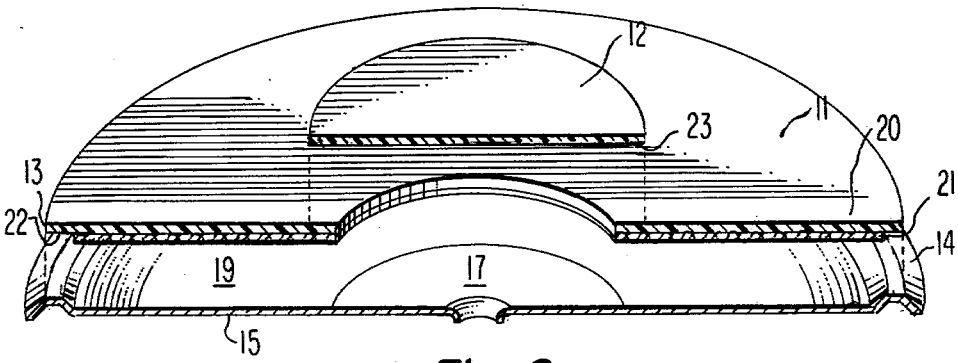
FIG. 2 is a blownup cross-sectional illustration of the record stamper protector of this invention shown in association with a record stamper.

The stamper protector 10 of this invention is comprised of a recording cover 11 and a center cover 12. The recording cover 11 is sufficiently large so that it can be secured about its outer edge 13 to the molding land 14 of a record stamper 15 on which it is to be adhered. A center hole 16 is provided at the center of the recording cover 11 to allow the unrecorded center portion 17 of the stamper 15 on which it is mounted to be exposed through the recording cover 11. The recording cover 11 has a width from the outer edge 13 to the edge 18 of the center hole which is sufficient to cover the entire recorded area 19 of the stamper 15 on which it is to be mounted.

The recording cover 11 is preferably made of a laminated material. The outer layer 20 of the recording cover 11, that is the layer which will be exposed when the cover is mounted on a stamper, is made of a relatively tough material which will resist penetration of scratching forces to the surface of the stamper. The material for outer layer 20 is selected with regard to both its physical properties and its thickness in order to have the desired protecting effect when mounted on the recorded surface 19 of the stamper 15. Various materials can be used for this purpose with materials such as plastic-impregnated high density paper and films of flexible plastics such as polypropylene being especially suitable for this purpose. The thickness of the outer layer 20 should be selected so as to have sufficient mechanical properties to protect the underlying stamper 15. Typically, this outer layer 20 should be at least about 0.3 cm thick. The upper limit of the thickness is not critical and is determined by practical considerations with the heavier materials giving better protection to the underlying stamper 15.

The recording cover 11 has an inner layer 21 which contacts the recorded surface 19 of the stamper 15 in use. The material selected for this layer should be a resilient material which has extremely low abrasive properties so as not to cause scratching of the stamper 15 when placed on the surface of the stamper. Various materials can be used for this purpose with low density, high bulk, unfilled papers and non-wovens being especially suitable for this purpose. The thickness of the inner layer 21 is selected to provide a certain amount of resilient protection to the surface of the record. The thickness should typically be about 0.3–0.4 cm thick, and advantageously can be of a thickness up to the heighth of the molding land 14 from the recorded area 19 of the stamper 15.

The outer diameter 13 of the outer layer 20 of the recording cover 11 is cut to fit into the upper surface of the molding land 14. The inner layer 21, however, is cut to a somewhat smaller diameter so as to overlie the recorded area 19 but not the molding land 14 of the stamper. A ring of a pressure-sensitive adhesive 22, such as an acrylic adhesive, is applied to the under side of the outer layer 20 from the outer edge 13 of the inner layer 21 at the outer edge 13 of the outer layer 20. This ring of adhesive 22 is positioned so that when the recording cover is placed over a stamper 15, the ring of adhesive 22 can be brought into a sealing engagement with the molding land 14 of the stamper 15.

The center cover 12 is cut to a size somewhat larger than the hole 16 in the center of the recording cover 11. The cover can be made of various conventional materials including the material used for the outer layer of the recording cover 11, and is generally of the same thickness so as to provide mechanical protection for the unrecorded center portion 17 of the stamper 15. However, there is no need with this particular part to use a soft inner layer in that the area of the stamper 15 which will be under the center cover 12 does not contain recorded information such as that which is covered by the recording cover 11. The center cover 12 also has a ring of adhesive 23 about its outer edge so that it can be secured to the outer layer 20 of the recording cover 11.

In use, stamper protector 10 is used to protect the surface of the stamper 15 from the time the stamper 15 is completed in the matrixing area to the time the stamper 15 is completely mounted in the molding press. Once the stamper has been completed and inspected in the matrixing area, the recording cover 11 is secured to the surface of the stamper 15. The ring of adhesive 22 on the outer edge of the recording cover 11 is secured to the molding land 14 of the stamper 15. The ring of adhesive 22 on the outer edge of the recording cover 11 is aligned with the molding land 14 of the stamper 15, and is pressed into sealing contact with the molding land 14. When this step is completed, the entire recorded area 19 of the stamper 15 will be protected. The unrecorded center portion 17 of the stamper 15 remains exposed. At this time, it is possible to more easily handle the stamper without causing damage to the recorded area 19 of the stamper. Identification of the stamper 24 (and the other indicated) can be engraved or otherwise recorded on the unrecorded portion 17 of the stamper 15. Once this is completed, the center cover 12 is placed on top of and aligned with the hole 16 in the center of the recording cover 11 and is pressed into sealing contact with the recording cover 11. When the recording cover 11 and the center cover 12 are sealed together, an air-tight cover is formed over the entire molding surface of the record.

When it is desired to use the stamper, the stamper is removed from storage and sent to the pressing area to be mounted on the press. The operators can readily check the identification of the stamper by simply removing the center cover 12 and checking the identification 24 on the unrecorded center portion 17 of the stamper 15. The removal of the center cover 12 does not expose the critical recorded area 19 of the stamper 15. The operator can then install the stamper 15 in a press for molding, leaving the recording cover 11 in place on the stamper 15 during the entire mounting of the stamper 15 in the press. The molding land 14 of the stamper 15 can be secured to the molding platen without disturbing the recording cover 11. In addition, the necessary mechanical connections can also be made at the center of the stamper 15 and without disturbing the recording cover 12. In this way, it is much simpler for the operator to install the stamper 15 in that he does not have to use the care heretofore required in order to prevent contacting the surface of the stamper. With his fingers the recording cover 11 also protects the recorded area 19 from being damaged by contact with tools and so forth. Once the stamper 15 is completely mounted in the press, the recording cover 11 can be readily removed by breaking the seal of the recording cover 11 to the molding land 14 and removing the recording cover 11 to expose the undamaged recorded area 19 of the stamper 15.

The stamper protector 10 of this invention has many unique advantages not found with other methods of protecting stampers. No residues are left on the molding surface of the stamper 15, as is common with films and the like, sprayed onto the surface of the stamper. The adhesive which is used to secure the recording cover 11 to the stamper 15, to the extent that it leaves any residue, leaves such residue on the molding land beyond the recorded surface of the stamper. Furthermore, the adhesive used to hold the center cover onto the recording cover only contacts the outer layer of the recording cover so that the adhesive does not come in contact with the unrecorded area 17 of the stamper 15 which is involved in the actual molding of the record.

A further advantage of the present invention is that the center cover 12 can be removed for the purpose of examining the identification 24 on the unrecorded center portion 17 of the stamper 15 without exposing the recorded area 19 of the record to damage.

What is claimed is:

1. A device for protecting the molding surface of a record stamper of the type having a molding land around the outer circumference, a recorded area extending from and adjacent to the molding land to a predetermined point radially inwardly from the molding land and an unrecorded area extending from the predetermined point to a center hole in said stamper; said device comprising in combination: a recording cover and a center cover; said recording cover being an annular member having an outer diameter and an inner diameter; said outer diameter being sufficiently wide so that the outer edge of the recording cover can be sealable engaged by means of adhesive provided at an edge thereof to the molding land of the stamper and being of a width from the outer diameter to the inner diameter sufficient to cover the recorded area of the stamper, said center cover being of a size larger than the inner diameter of the recording cover and being releasably adhered to a surface of the recording cover over the inner diameter thereof, whereby when said recording cover is adhered to the molding land of the stamper it protects the recorded area of the stamper and when the center cover is applied over the inner diameter of the recording cover and sealed to the recording cover, the molding surface of the record stamper is protected from scratches and surface contamination.

2. The device according to claim 1 wherein the recording cover is made of a laminated material having an inner layer which is to be brought into contact with the recorded area comprised of a resilient, non-abrasive material, and an outer layer comprised of a mechanically tough material selected to resist penetration of scratches due to imparted forces to the recorded area.

3. The device according to claim 2, wherein the outer layer extends the entire width of the recording cover, and which includes a ring of adhesive on its inner surface positioned to selectively adhere to the molding land.

4. The device according to claim 3, wherein the inner layer commences inwardly for the outer diameter and is of a width sufficient to cover the recorded area.

5. The device according to claim 4, wherein the inner layer is made of a material which will not adhere to the recorded area.

6. The device according to claim 2, wherein the outer layer is made of a plastic impregnated high-density paper and is at least about 0.3 cm thick.

7. The device according to claim 2, wherein the inner layer is made of a high bulk, unfilled, non-woven fabric having a thickness of about 0.3–0.4 cm.

* * * * *